US008814119B2

(12) United States Patent
Boychuk et al.

(10) Patent No.: US 8,814,119 B2
(45) Date of Patent: Aug. 26, 2014

(54) ARBOR APPARATUS FOR COUNTERWEIGHT RIGGING SYSTEM

(75) Inventors: Richard William Boychuk, Toronto (CA); Jeremy Carl Anderson, Winona, MN (US)

(73) Assignee: Grid Well Inc., Toronto (CA)

( * ) Notice: Subject to any disclaimer, the term of this patent is extended or adjusted under 35 U.S.C. 154(b) by 625 days.

(21) Appl. No.: 12/757,369

(22) Filed: Apr. 9, 2010

(65) Prior Publication Data

US 2010/0258699 A1 Oct. 14, 2010

Related U.S. Application Data

(60) Provisional application No. 61/168,091, filed on Apr. 9, 2009.

(51) Int. Cl.
*A47H 1/10* (2006.01)

(52) U.S. Cl.
USPC ..... 248/331; 248/325; 248/320; 248/328; 16/400; 472/78

(58) Field of Classification Search
USPC ..... 248/331, 332, 317, 320, 325, 327, 328; 254/388, 331, 334, 283; 472/75, 79, 472/57, 76, 77, 78, 80; 16/400, 94 R, 94 D, 16/95 R, 95 D, 96 D
See application file for complete search history.

(56) References Cited

U.S. PATENT DOCUMENTS

| | | | | |
|---|---|---|---|---|
| 1,261,775 | A * | 4/1918 | Curran | 472/78 |
| 2,142,063 | A * | 12/1938 | Tompkins | 472/78 |
| 3,165,296 | A | 1/1965 | Drew | |
| 3,690,617 | A * | 9/1972 | Butler | 472/78 |
| 4,134,177 | A * | 1/1979 | Janson | 16/96 D |
| 4,795,405 | A | 1/1989 | Davis et al. | |
| 5,106,057 | A * | 4/1992 | Feller et al. | 254/334 |
| 5,711,713 | A | 1/1998 | Krueger | |
| 6,385,493 | B1 * | 5/2002 | Hennessey et al. | 700/65 |
| 6,537,155 | B2 | 3/2003 | Steve et al. | |
| 6,855,063 | B2 | 2/2005 | Murphy et al. | |
| 7,677,623 | B2 * | 3/2010 | Bath et al. | 294/81.5 |
| 2002/0082096 | A1 * | 6/2002 | Walker et al. | 472/75 |

OTHER PUBLICATIONS

J.R. Clancy, Inc., Rigging System Design Guide, 2009, Syracuse, New York, USA.
Photographs of arbor rigging installation at St. Scholastica Academy, Chicago, Illinois, USA, 2007.

* cited by examiner

*Primary Examiner* — Terrell McKinnon
*Assistant Examiner* — Monica Millner
(74) *Attorney, Agent, or Firm* — Price Heneveld LLP

(57) ABSTRACT

An arbor apparatus for use in a counterweight rigging system includes a support structure for supporting counterweight bricks in stacked arrangement. The arbor apparatus can be front-loading with left side, back and right side supports. The arbor apparatus can include a plurality of shelf members spaced apart in a longitudinal direction between the top and bottom ends. The arbor apparatus can also include a gate mechanism. The arbor apparatus can be implemented as a retrofit to existing manual counterweight rigging systems.

16 Claims, 8 Drawing Sheets

ARBOR APPARATUS FOR COUNTERWEIGHT RIGGING SYSTEM

CROSS REFERENCE TO RELATED APPLICATION

This application claims priority to U.S. Provisional Application No. 61/168,091 filed on Apr. 9, 2009 and entitled ARBOR APPARATUS FOR COUNTERWEIGHT RIGGING SYSTEM, the entire contents of which are hereby incorporated herein by reference.

FIELD

The teachings disclosed herein relate to manual counterweight rigging apparatuses and systems.

BACKGROUND

The following paragraphs are not an admission that anything discussed in them is prior art or part of the knowledge of persons skilled in the art.

U.S. Pat. No. 3,165,296 (Drew) discloses an apparatus for raising and lowering stage drops. A movable support member is provided for supporting a stage drop. A head block such as a pulley having a plurality of grooves is mounted adjacent the top position of the stage drop. An arbor adapted to carry weight for counterbalancing the stage drop is disposed below the head block. A plurality of flexible supporting cables are disposed over the head block and connected at one end to the support member and at the other end to the arbor. A control cable is connected at each end to the arbor and means for supporting the control cables above and below the arbor are provided so that the arbor is moved in a downward direction when the control cable is moved in one direction and the arbor is moved in an upward direction when the control cable is moved in the other direction. An electric motor is coupled to the control cable. A source of energizing potential is connected to the motor through motor control means for controlling the motor to selectively raise and lower the arbor and thereby raise and lower the stage drop.

U.S. Pat. No. 5,711,713 (Krueger) discloses a modified theatrical counterweight apparatus in a double or single purchase counterweight system, which consists of a counterweight arbor carriage for holding a plurality of counterweights. The counterweights are stored on two elongate arbor bars, which when released will slide down into the counterweight arbor carriage. The counterweight arbor carriage when obtaining the proper amount of the counterweights will slide down the elongate arbor bars to raise a piece of scenery with a batten up from a stage, via lift lines and an operating line.

SUMMARY

In an aspect of this specification, an arbor apparatus for use in a counterweight rigging system includes: a support structure extending generally in a longitudinal direction between top and bottom ends, the support structure including a left side support, a back support, and a right side support, the left side, back and right side supports extending generally in the longitudinal direction between the top and bottom ends and defining an elongate carrying section therebetween, the carrying section sized and shaped to receive a plurality of counterweight bricks in stacked arrangement; and a plurality of shelf members coupled to the support structure and adapted to support the counterweight bricks in the carrying section.

In another aspect of this specification, a counterweight rigging system includes: a plurality of counterweight bricks, each counterweight brick including top and bottom sides and left, right, front and back side edges defining a generally cuboidal shape allowing stacked arrangement; and at least one arbor apparatus, the apparatus including a support structure extending generally vertically between top and bottom ends, the support structure including a left side support, a back support, and a right side support, the left side, back and right side supports extending generally between the top and bottom ends and defining an elongate carrying section therebetween sized and shaped to receive a plurality of counterweight bricks in stacked arrangement, wherein a front opening of the carrying section is defined by the left side and right side supports and is at least as wide as a width of each of the counterweight bricks between the left and right side edges.

In yet another aspect of this specification, a front-loading arbor apparatus for use in a counterweight rigging system includes: a support structure extending generally in a longitudinal direction between top and bottom ends, the support structure including a left side support, a back support, and a right side support, the left side, back and right side supports extending generally in the longitudinal direction between the top and bottom ends and defining an elongate carrying section therebetween, the carrying section sized and shaped to receive a plurality of counterweight bricks in stacked arrangement; at least one shelf member coupled to the support structure and adapted to support the counterweight bricks in the carrying section; and a guard member extending generally in the longitudinal direction at least partially between the top and bottom ends, the guard member movable between open and blocking positions for respectively allowing and obstructing removal of the counterweight bricks from the carrying section.

Other aspects and features of the teachings disclosed herein will become apparent, to those ordinarily skilled in the art, upon review of the following description of the specific examples of the specification.

DRAWINGS

The drawings included herewith are for illustrating various examples of articles, methods, and apparatuses of the present specification and are not intended to limit the scope of what is taught in any way. In the drawings.

DESCRIPTION OF VARIOUS EMBODIMENTS

Figure 1:
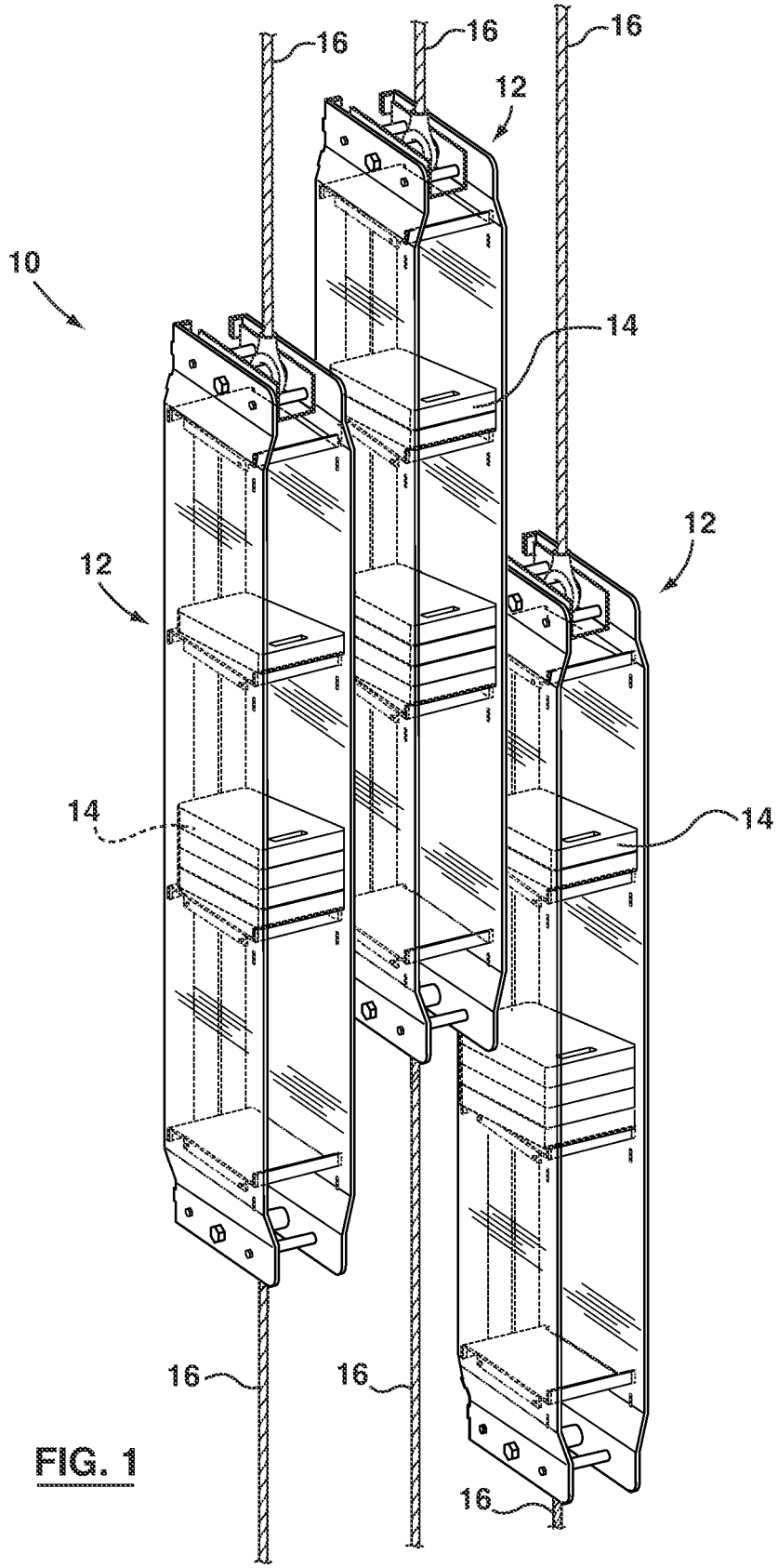
FIG. 1 is a perspective view of a plurality of an example of an arbor apparatus.
Figure 2A:
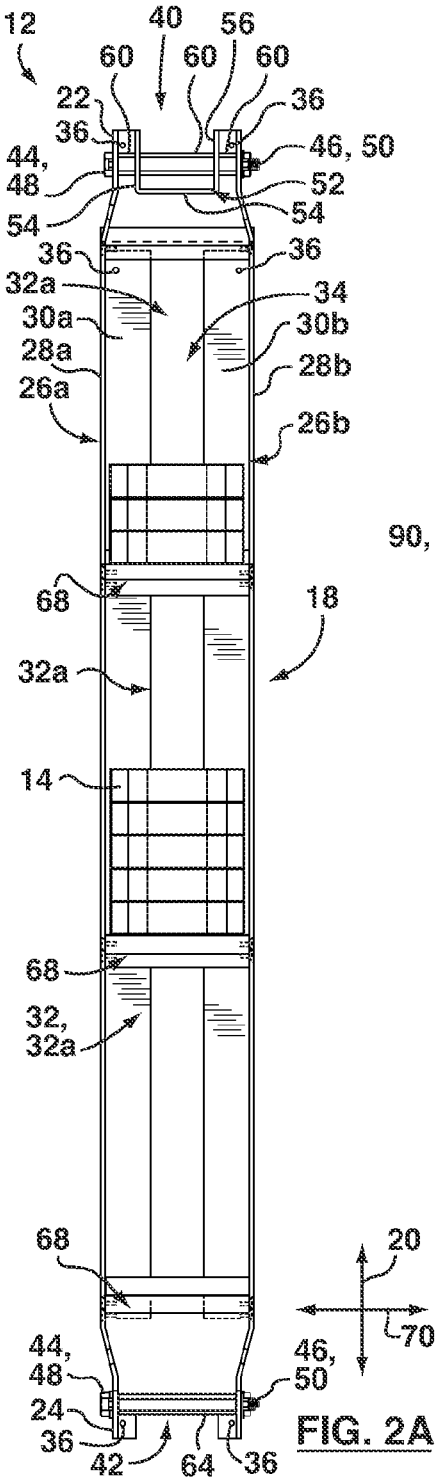
FIGS. 2A, 2B, 2C and 2D are front, top, side and exploded perspective views, respectively, of one of the arbor apparatuses shown in FIG. 1.
Figure 2B:
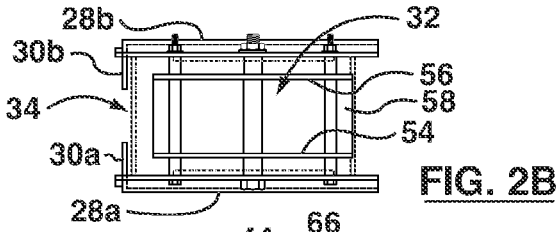
Figure 2C:
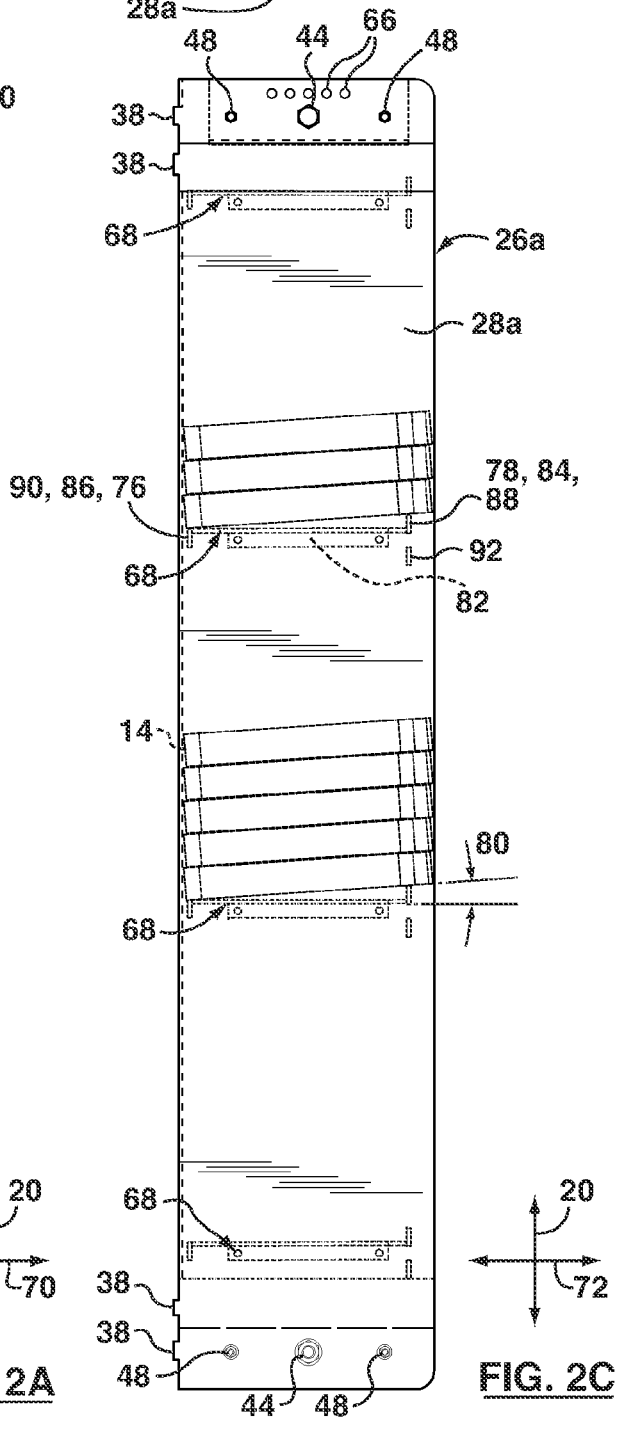
Figure 2D:
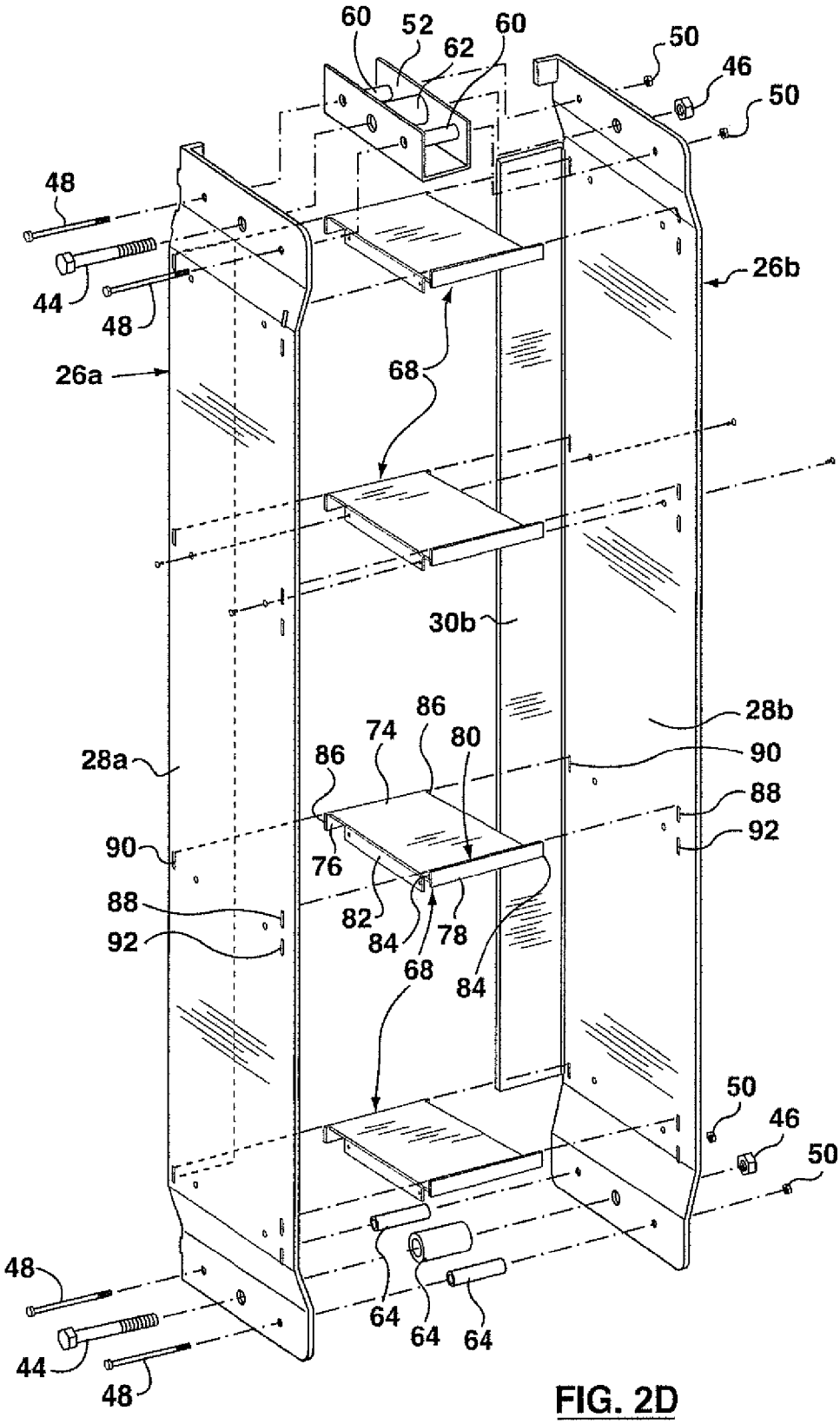

Various apparatuses or processes will be described below to provide an example of an embodiment of each claimed invention. No embodiment described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention. The applicants, inventors or owners reserve all rights that they may have in any invention disclosed in an apparatus or process described below that is not claimed in this document, for example the right to claim such an invention in a continuing application and do not intend to abandon, disclaim or dedicate to the public any such invention by its disclosure in this document.

Manual counterweight rigging systems are well known and are typically used on live performance stages as a method of counterbalancing the changing weights of different scenery or lighting battens, which can become heavier or lighter as scenery or lighting fixtures are added or removed.

Known counterweight rigging systems can include arbor apparatuses that have two vertical arbor rods which receive elongated, roughly H-shaped counterweight bricks. Such known counterweight rigging systems can suffer from a number of drawbacks. For example, known counterweight bricks can be of a shape that is unwieldy for the loader, and difficult to carry with a single hand. Furthermore, the method in which counterweight bricks are installed and removed from the arbor apparatuses can be difficult and potentially hazardous. The method in which counterweight bricks are installed and removed from the arbor apparatuses can also dictate that the arbor apparatuses are a substantial amount taller than actually required for the amount of counterweight bricks needed. Moreover, in the event of a "runaway", the arbor rods can be prone to bowing out when under stress, which can result in counterweight bricks falling off of the arbor apparatus. To counter potential distortion of the arbor rods, known counterweight rigging systems can include so-called "spreader plates", which serve as active safety devices.

Applicant's teachings relate to a front-loading arbor apparatus for use in a counterweight rigging system that includes a rigid support structure for supporting counterweight bricks in stacked arrangement. The top and bottom ends of the arbor apparatus include respective top and bottom connectors adapted for connection to loft cables or operating ropes or lines to suspend the arbor apparatus in use. The arbor apparatus can include a plurality of shelf members that extend generally in a lateral direction and are spaced apart in a longitudinal direction between the top and bottom ends. The arbor apparatus can also include a gate mechanism for preventing ejection of the counterweight bricks from the arbor apparatus. The arbor apparatus can be implemented as a retrofit to existing manual counterweight rigging systems.

Referring to FIG. 1, a counterweight rigging system 10 can include a plurality of arbor apparatuses shown generally at 12. Each of the arbor apparatuses 12 are adapted to support a plurality of counterweight bricks 14 in stacked arrangement, as described in further detail below.

As illustrated, the arbor apparatuses 12 can be arranged in series, suspended between operating lines 16. The operating lines 16 can extend vertically upwards from the arbor apparatuses 12 to a head block (not shown), and vertically downwards from the arbor apparatuses 12 to a foot block (not shown). For clarity and convenience, the counterweight rigging system 10 is illustrated without loft cables connected to the arbor apparatuses 12. Typically, loft cables (in some examples there may be as few as two and as many as ten or twelve) extend vertically upward to the head and loft blocks (not shown), and redirected vertically downwardly to a batten (not shown). Furthermore, for clarity and convenience, the counterweight rigging system 10 is illustrated without guide systems (shoes, rollers, etc.) implemented with the arbor apparatuses 12.

Referring to FIGS. 2A, 2B, 2C and 2D, the arbor apparatus 12 includes a rigid support structure 18 extending generally in a vertical or longitudinal direction 20 between top and bottom ends 22, 24.

In some examples, the support structure 18 can include first and second body members 26*a*, 26*b* that extend between the top and bottom ends 22, 24. Each of the body members 26*a*, 26*b* can include an elongate side portion 28*a*, 28*b* and an elongate back portion 30*a*, 30*b* respectively connected to the side portion 28*a*, 28*b*. The side portions 28*a*, 28*b* and the back portions 30*a*, 30*b* extend in the longitudinal direction 20 between the top and bottom ends 22, 24 to define an elongate carrying section 32. The carrying section 32 is sized and shaped to receive the counterweight bricks 14 in stacked arrangement. The carrying section 32 is accessible through a front opening that is defined by the side portions 28*a*, 28*b*.

In particular, the side portions 28*a*, 28*b* can be generally orthogonal to the back portions 30*a*, 30*b*. The body members 26*a*, 26*b* can be arranged so that the side portions 28*a*, 28*b* are in generally opposed relation, with the side portion 28*a* defining a left side support of the support structure 18, and the side portion 28*b* defining a right side support of the support structure 18. The body members 26*a*, 26*b* can be arranged so that the back portions 30*a*, 30*b* are generally coplanar and define a back support of the support structure 18.

As illustrated, the front opening defined by the side portions 28*a*, 28*b* is substantially unobstructed between the top and bottom ends 22, 24 and is at least as wide as a width of the counterweight bricks 14 so that they can be placed directly in the apparatus 12 from the front. Thus, the arbor apparatus 12 is front-loading from the perspective of the loader. The counterweight bricks 14 can be slid into the front of the arbor apparatus 12 and positioned in stacked arrangement, without having to twist or otherwise manipulate the counterweight bricks 14 laterally.

The back portions 30*a*, 30*b* of the body members 26*a*, 26*b* can be spaced apart to define an elongate gap 34 therebetween. The gap 34 can allow for the counterweight bricks 14 to be seen from behind the arbor apparatus 12 when the counterweight bricks are positioned in the carrying section 32.

Optionally, proximate to the top and bottom ends 22, 24, a number of holes 36 and/or tabs 38 can be included that are compatible with universal shoes and/or rollers of guide systems (not shown) that can be provided by various manufacturers, which can allow the arbor apparatus 12 to be implemented as a retrofit product for existing installations.

The top and bottom ends 22, 24 include respective top and bottom connectors 40, 42 adapted for connection to loft cables and/or operating lines to suspend the arbor apparatus 12 in use.

In some particular examples, the top and bottom connectors 40, 42 can include bolts 44, 48 and nuts 46, 50. As illustrated, the bolts 44, 48 can extend between the body members 26*a*, 26*b* proximate to both the top and bottom ends 22, 24 and provide attachment points for loft cables and/or operating lines. Although bolts are illustrated as attachment points for the arbor apparatus 12, other suitable connection means can be used for the top and bottom connectors 40, 42 to connect the arbor apparatus 12 to loft cables and/or operating lines.

In some particular examples, with the arbor apparatus 12 implemented in a single purchase configuration, as illustrated, the top connector 40 can include a generally U-shaped connection channel 52 having first and second side portions 54, 56 and a bottom portion 58. The side portions 54, 56 of the connection channel 52 can be arranged in parallel with the side portions 28*a*, 28*b* of the first and second body members 26*a*, 26*b*, and with the bolts 44, 48 extending through the side portions 54, 56 and the side portions 28*a*, 28*b*. The connection channel 52 is therefore connected to the body members 26*a*, 26*b* by the bolts 44, 48, along with appropriate spacers 60. The bottom connector 42 also includes an appropriate spacer 64 for use in conjunction with the bolts 44, 48. The connection channel 52 can further include a plurality of holes 66 for attaching the loft cables (not shown) to the arbor apparatus.

For both the top and bottom connectors 40, 42, the operating lines can be connected to bolts 44 directly or indirectly via spacers 60, 64, respectively. The bolts 44, 48 and the spacers 60, 64 can be selected so that the dimension between the side portions 28*a*, 28*b* can be adjusted to accommodate counterweight bricks 14 of varying width dimensions.

The arbor apparatus 12 can further include a plurality of shelf members 68 adapted to support a plurality of counterweight bricks 14 in stacked arrangement. Each of the shelf members 68 can extend generally in lateral and depth directions 70, 72 (lateral and depth directions 70, 72 can be roughly horizontal), and can be spaced apart in the longitudinal direction 20 between the top and bottom ends 22, 24, thereby defining a plurality of carrying subsections 32*a*, each of the carrying subsections 32*a* sized and shaped to receive the counterweight bricks 14 in stacked arrangement. The shelf members 68 can serve to enhance structural rigidity of the arbor apparatus, and provide the loader with various stacking heights to choose from when loading the counterweight bricks 14 into the carrying subsections 32*a*.

In some examples, the shelf members 68 can support a plurality of the counterweight bricks 14 in stacked arrangement so that each of the counterweight bricks 14 is roughly balanced in the arbor apparatus 12 in both the lateral and depth directions 70, 72.

In some examples, each of the shelf members 68 can include a main supporting portion 74, a rear flange portion 76 that projects generally in the longitudinal direction 20 towards the bottom end 24, and a front flange portion 78 that projects generally in the longitudinal direction 20 towards the top end 22. The front flange portion 78 can include a brick-supporting lip 80 that can extend generally between the side portions 28*a*, 28*b*. The shelf member 68 can be dimensioned so that when the counterweight brick 14 is positioned within the carrying section 32*a* it is inclined at angle 80 relative to the main supporting portion 74, so that a front side edge of the counterweight brick 14 is closer to the top end 22 than a rear side edge of the counterweight brick 14. In some examples, the shelf members 68 can be adapted to support the counterweight bricks inclined at an angle 80 of between about five and twenty degrees. The angle 80 serves to bias the counterweight bricks 14 to bear against the back portions 30*a*, 30*b*, and thus can reduce the likelihood of frontward ejection of the counterweight bricks 14 from the carrying sections 32*a*.

Each of the shelf members 68 can further include first and second side flange portions 82. The side flange portions 82 can be affixed to the side portions 28*a*, 28*b* and enhance structural rigidity. In some examples, screws or welding can be used to affix the side flange portions 82 to the side portions 28*a*, 28*b*.

The front and rear flange portions 78, 76 of each of the shelf members 68 can include respective front and rear tabs 84, 86 extending outwardly relative to the main supporting portion 74 on both sides thereof. The side portions 28*a*, 28*b* can include a plurality of first front slots 88 and rear slots 90 aligned in registration with the front and rear tabs 84, 86 for respectively receiving the front and rear tabs 84, 86. The tabs 84, 86 and slots 88, 90 serve to transfer weight of the counterweight bricks 14 on the shelf members 68 to the body members 26*a*, 26*b*. The tabs 84, 86 and slots 88, 90 can also facilitate quick and easy assembly of the shelf members 68 and the body members 26*a*, 26*b*.

Upper ends of the rear slots 90 can be at the same general position in the longitudinal direction 20 as lower ends of respective ones of the first front slots 88. The side portions 28*a*, 28*b* can further include second front slots 92. Lower ends of the rear slots 90 can be at the same general position in the longitudinal direction 20 as upper ends of the respective ones of the second front slots 92 so that the body members 26*a*, 26*b* can be of identical or interchangeable configuration, which can thus simplify manufacture and assembly of the arbor apparatus 12.

The body portions 26*a*, 26*b*, the carrying section 32 and the shelf members 68 can all be formed of sheet or plate metal material of a suitable thickness. If the body portions 26*a*, 26*b*, the carrying section 32 and the shelf members 68 are formed of plate metal material of a sufficient thickness, the weight of the arbor apparatus 12 can be sufficiently heavy to reduce the number of counterweight bricks 14 required to achieve balance with an empty batten.

Figure 3B:
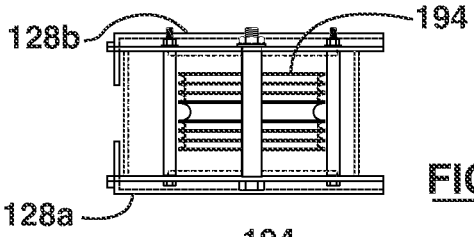
FIGS. 3A, 3B and 3C are front, top and side views, respectively, of another example of an arbor apparatus.
Figure 3A:
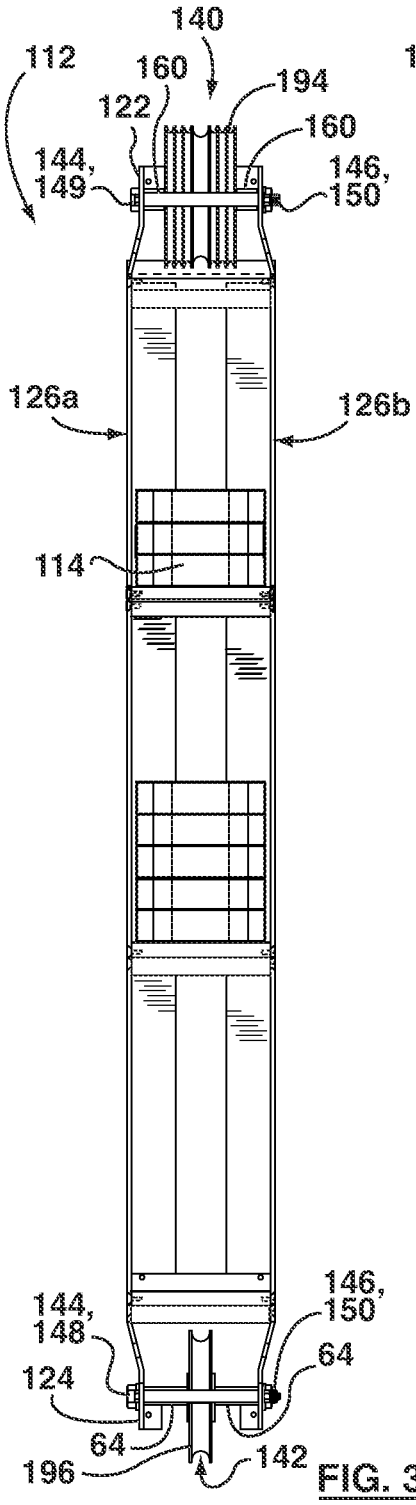
Figure 3C:
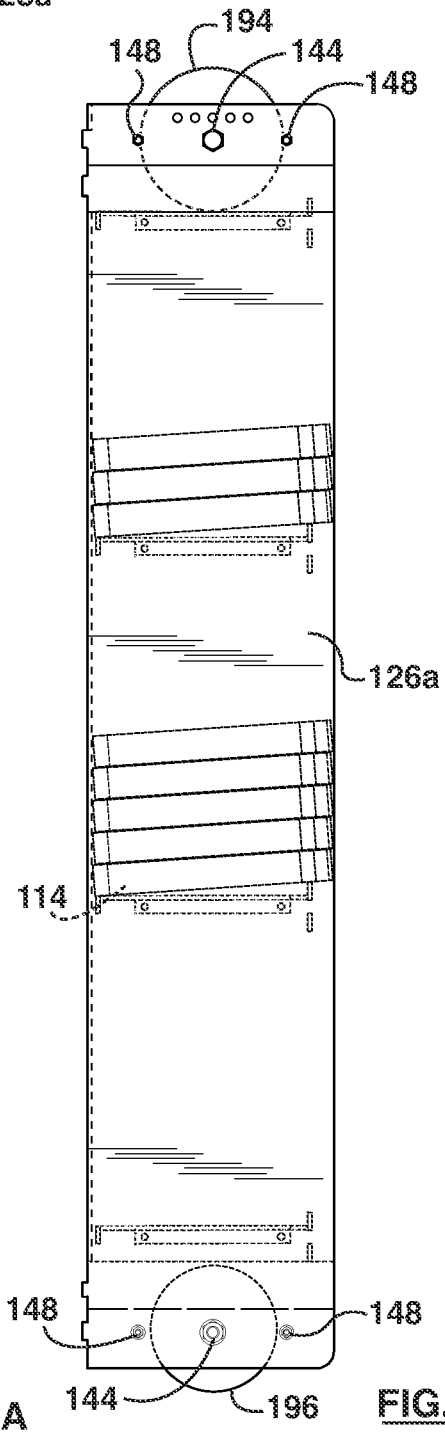

Referring to FIGS. 3A, 3B and 3C, another example of an arbor apparatus is shown generally at 112. The arbor apparatus 112 is similar to the arbor apparatus 12, with like features identified by like reference numbers.

The top and bottom ends 122, 124 include respective top and bottom connectors 140, 142 adapted for connection to loft cables and/or operating lines to suspend the arbor apparatus 112 in use. As illustrated, the top and bottom connectors 140, 142 can include bolts 144, 148 and nuts 146, 150. As illustrated, the bolts 144, 148 can extend between the body members 126*a*, 126*b* proximate to both the top and bottom ends 122, 124 and provide attachment points for loft cables and/or operating lines.

In some particular examples, with the arbor apparatus 112 implemented in a double purchase configuration, as illustrated, the top connector 40 can include a multi-groove sheave 194. The sheave 194 can be sized and shaped to accommodate loft cables and an operating line. The sheave 194 can be connected to the body members 126*a*, 126*b* by the bolt 144, along with appropriate spacers 160. The bottom connector 42 can include a single-groove sheave 196. The sheave 196 can be sized and shaped to accommodate an operating line. The sheave 196 can be connected to the body members 126*a*, 126*b* by the bolt 144, along with appropriate spacers 164. The sheaves 194, 196 rotate about bolts 144. The bolts 144, 148 and the spacers 160, 164 can be selected so that the dimension between the side portions 128*a*, 128*b* can be adjusted to accommodate counterweight bricks 114 of varying width dimensions.

Figure 4B:
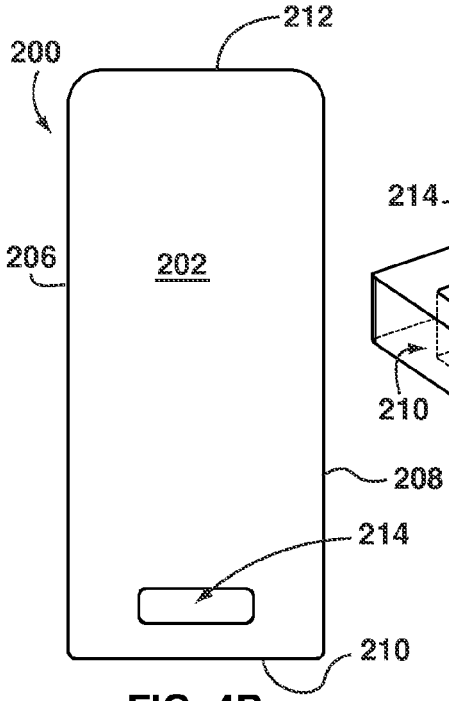
FIGS. 4A, 4B and 4C are perspective, top and front views, respectively, of an example of a counterweight brick.
Figure 4A:
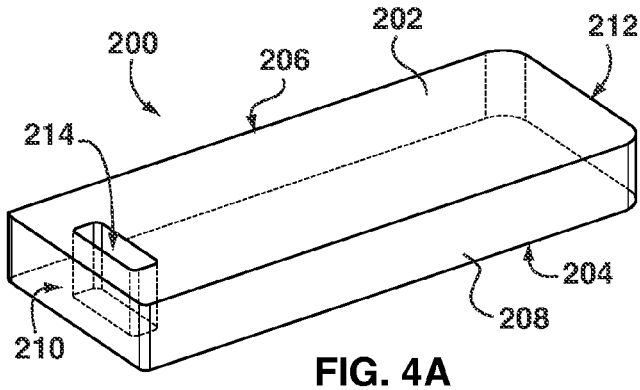
Figure 4C:
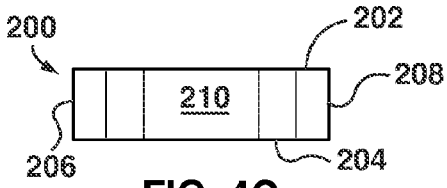

Referring to FIGS. 4A, 4B and 4C, an example of a counterweight brick is shown generally at 200. The counterweight brick 200 can include top and bottom sides 202, 204 that allow for a stacked arrangement.

In some examples, the counterweight brick 200 can further include a left side edge 206, a right side edge 208, a front side edge 210, and a back side edge 212. The sides 202, 204 and the side edges 206, 208, 210 and 212 can define a generally cuboidal shape. The counterweight brick 200 can further include a handle opening 214 proximate to one of the side edges 206, 208, 210 and 212. The handle opening can extend between the sides 202, 204. The counterweight brick can be formed of a relatively inexpensive and relatively heavy material, for example but not limited to, iron or steel. The counterweight brick can be formed to various dimensions.

Figure 5B:
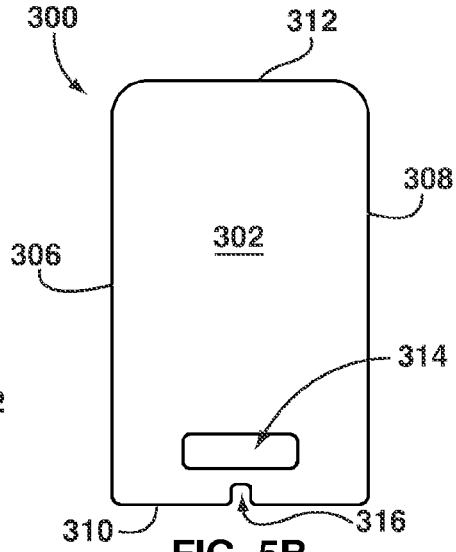
FIGS. 5A, 5B and 5C are perspective, top and front views, respectively, of another example of a counterweight brick.
Figure 5A:
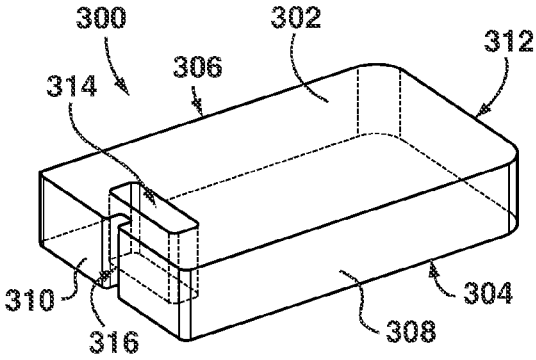
Figure 5C:
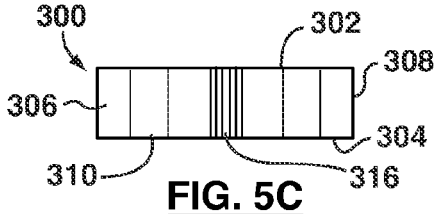

Referring to FIGS. 5A, 5B and 5C, another example of a counterweight brick is shown generally at 300. The counterweight brick 300 is similar to the counterweight brick 200, with like features identified by like reference numbers. The counterweight brick 300 includes an indentation 316 along the front side edge 310 and extending between the top and bottom sides 302, 304. The indentation 316 is sized and shaped to receive a guard member of a gate mechanism, as described in further detail below.

Figure 6A:
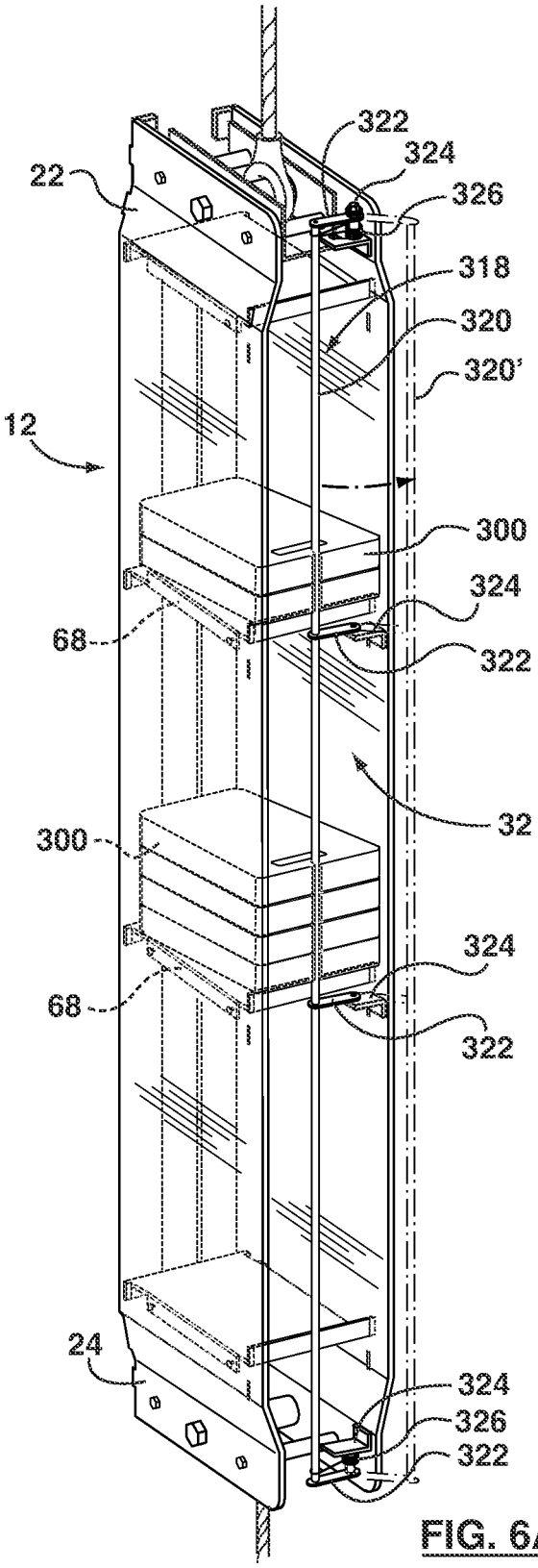
FIGS. 6A, 6B and 6C are perspective, top and sectional views, respectively, of another example of an arbor apparatus including a gate mechanism.
Figure 6B:
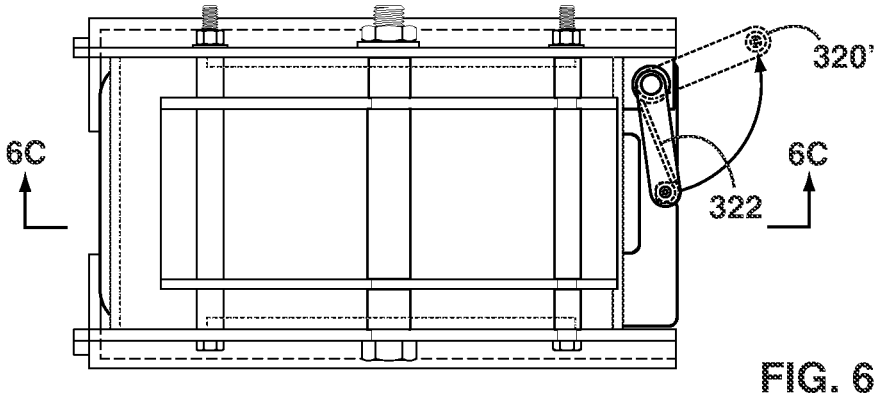
Figure 6C:
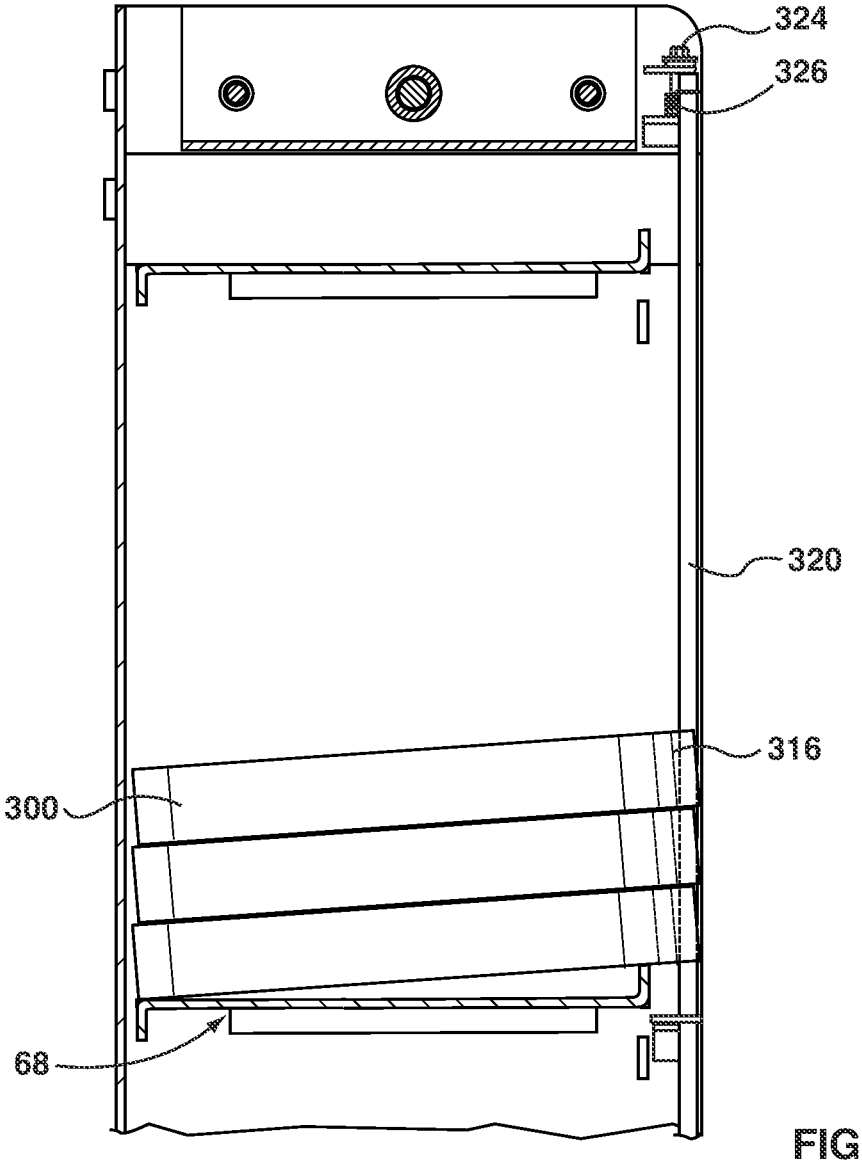

Referring to FIGS. 6A, 6B and 6C, a gate mechanism 318 is shown in use with the arbor apparatus 12 for preventing ejection of the counterweight bricks 300 from the carrying section 32. The gate mechanism 318 includes a guard member 320 extending at least partially between the top and bottom ends 22, 24. The guard member 320 is movable between an open position (shown in stippled lines as 320') and a blocking position for respectively allowing and obstructing removal of the counterweight bricks 300 from the carrying section 32. In the blocking position, the guard member 320 generally blocks the front opening of the carrying section 32. The guard member 320 can be biased towards the blocking position.

In use, a latch (not shown) can be used to hold the guard member 320 in the open position 320' to allow installation or removal of the counterweight bricks 300, or alternatively one of the counterweight bricks 300 can be partially pulled out pulled out of the carrying section 32 and prevent the guard member 320 from returning to the blocking position.

In some examples, the gate mechanism 318 can include a plurality of pivoting arms 322 mounted to bases 324. The guard member 320 can be attached to ends of the pivoting arms 322 and pivotally movable about the bases 324 to move between the open position and the blocking position. At least one torsion spring 326 can bias the guard member 320 towards the blocking position As illustrated, the indentation 316 of the counterweight brick 300 is sized and shaped to receive the guard member 320, thus stabilizing the position of each of the counterweight bricks 300 and preventing ejection of the counterweight bricks 300 from the carrying section 32. However, the gate mechanism 318 can also be implemented with a counterweight brick not including the indentation 316, in which case the guard member 320 would bear against a front side edge of the counterweight brick and similarly prevent the ejection of the counterweight bricks 300 from the carrying section 32.

Figure 7A:
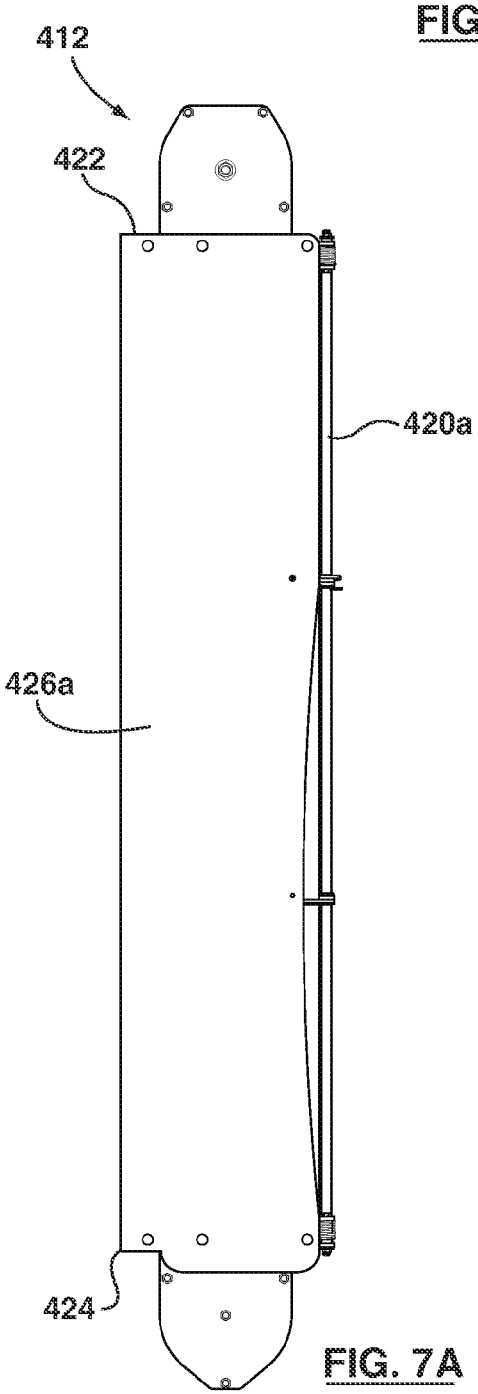
FIGS. 7A, 7B and 7C are side, top and front views, respectively, of another example of an arbor apparatus.
Figure 7B:
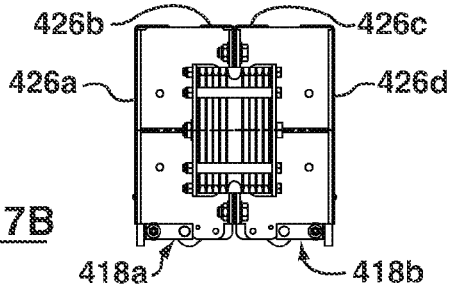
Figure 7C:
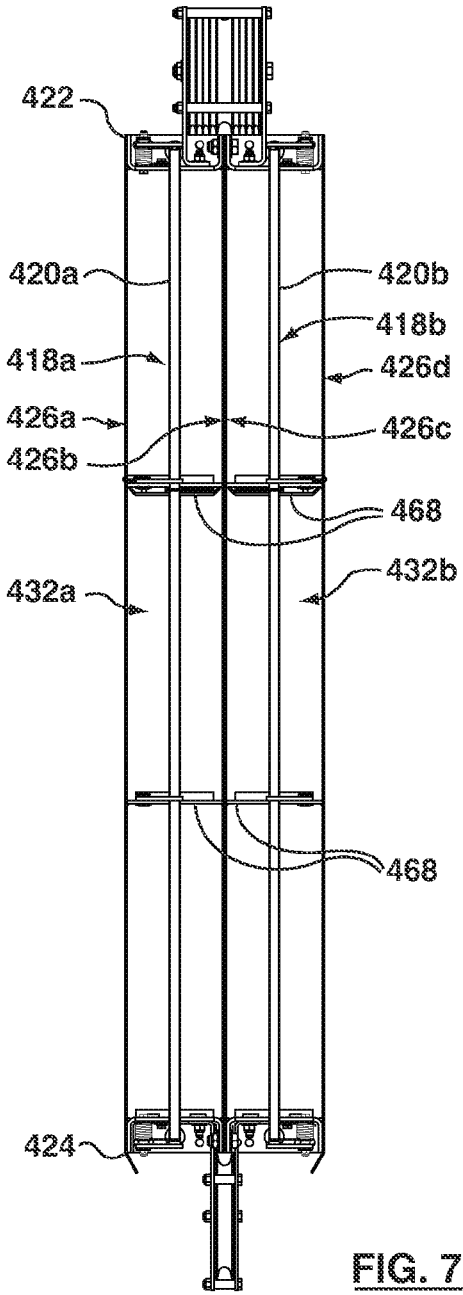

Referring to FIGS. 7A, 7B and 7C, another example of an arbor apparatus is shown generally at 412. The arbor apparatus 412 is similar to the arbor apparatus 12 and 112, with like features identified by like reference numbers.

The apparatus 412 includes first and second body members 426*a*, 426*b* that extend between top and bottom ends 422, 424 and define an elongate carrying section 432*a*. The apparatus 412 also includes first and second body members 426*c*, 426*d* that extend between the top and bottom ends 422, 424, and define an elongate carrying section 432*b*. As illustrated, the second body member 426*b* can be fastened or otherwise affixed to the first body member 426*c*. The carrying sections 432*a*, 432*b* are arranged side-by-side and in parallel, and each is sized and shaped to receive the counterweight bricks in stacked arrangement. The apparatus 412 is illustrated with two carrying sections 432*a*, 432*b*. It should be appreciated that other configurations are possible, including, for example but not limited to, apparatuses with three or four carrying sections.

As illustrated, the apparatus 412 further includes a plurality of shelf members 468 adapted to support a plurality of counterweight bricks in stacked arrangement. The shelf members 468 are spaced apart between the top and bottom ends 422, 424 thereby subdividing the carrying sections 432*a*, 432*b* into carrying subsections. The shelf members 468 can serve to enhance structural rigidity of the apparatus 412, and provide the loader with various stacking heights to choose from when loading the counterweight bricks into the carrying subsections.

As illustrated, the apparatus 412 includes gate mechanisms 418*b*, 418*b* for preventing ejection of the counterweight bricks from the carrying sections 432*a*, 432*b*, respectively. The gate mechanisms 418*b*, 418*b* include respective guard members 420*a*, 420*b* extending at least partially between the top and bottom ends 422, 424 of the apparatus 412.

While the above description provides examples of one or more processes or apparatuses, it will be appreciated that other processes or apparatuses may be within the scope of the accompanying claims.

We claim:

1. A front-loading arbor apparatus for use in a counterweight rigging system of a stage comprising a plurality of counterweight bricks, the apparatus comprising:

a) a support structure extending generally in a longitudinal direction between top and bottom ends, the support structure including a left side support, a back support, and a right side support, the left side, back and right side supports extending generally in the longitudinal direction between the top and bottom ends and defining an elongate carrying section therebetween, the carrying section accessible through a front opening defined by the left side and right side supports, the front opening sized and shaped to receive the plurality of counterweight bricks in stacked arrangement; and b) a plurality of shelf members coupled to the support structure, each of the plurality of shelf members extending generally in a lateral direction between the left side and right side supports and spaced apart in the longitudinal direction between the top and bottom ends to define a plurality of carrying subsections;

wherein each of the carrying subsections is sized and shaped to receive at least a portion of the counterweight bricks in stacked arrangement and the respective shelf member supports the counterweight bricks received by the carrying subsection from below;

wherein the support structure further comprises first and second body members that extend between the top and bottom ends, each of the body members comprising an elongate side portion, the body members arranged so that the side portions are in generally opposed relation and define the respective left and right side supports;

wherein each of the body members further comprises an elongate back portion connected generally orthogonally to the respective side portion, the body members arranged so that the back portions are generally coplanar and define the back support, and the back portions of the body members are spaced apart to define an elongate gap therebetween; and wherein each of the shelf members comprises a main supporting portion, a rear flange portion that projects generally in the longitudinal direction towards the bottom end, and a front flange portion that projects generally in the longitudinal direction towards the top end.

2. The apparatus of claim 1, wherein the front flange portion includes a brick-supporting lip that extends generally between the side portions of the body members.

3. The apparatus of claim 1, wherein each of the shelf members further comprises first and second side flange portions affixed to the side portions of the body members.

4. The apparatus of claim 1, wherein the front and rear flange portions of each of the shelf members comprise respective front and rear tabs extending outwardly relative to the main supporting portion on both sides thereof, and the side portions of the body members include a plurality of first front slots and rear slots for respectively receiving the front and rear tabs of the shelf members.

5. The apparatus of claim 4, wherein upper ends of the rear slots are at the same general position in the longitudinal direction as lower ends of respective ones of the first front slots.

6. The apparatus of claim 5, wherein each of the body members further comprises a plurality of second front slots, and lower ends of the rear slots are at the same general position in the longitudinal direction as upper ends of the respective ones of the second front slots so that the first and second body members are of interchangeable configuration.

7. The apparatus of claim 1, wherein the top and bottom ends comprise respective top and bottom connectors adapted for connection to loft cables or operating lines to suspend the arbor apparatus.

8. The apparatus of claim 7, wherein the top and bottom connectors comprise bolts extending between the body members, and the top connector further comprises a generally U-shaped connection channel having first and second side portions and a bottom portion, the side portions of the connection channel arranged in parallel with the side portions of the first and second body members, and with the bolts extending therethrough.

9. A counterweight rigging system for a stage, comprising:

a) a plurality of counterweight bricks, each counterweight brick including top and bottom sides and left, right, front and back side edges defining a generally cuboidal shape allowing stacked arrangement; and b) at least one front-loading arbor apparatus, the apparatus including a support structure extending generally vertically between top and bottom ends, the support structure including a left side support, a back support, and a right side support, the left side, back and right side supports extending generally between the top and bottom ends and defining an elongate carrying section therebetween, the carrying section sized and shaped to receive the plurality of counterweight bricks in stacked arrangement;

wherein a front opening of the carrying section is defined by the left side and right side supports and is at least as wide as a width of each of the counterweight bricks between the left and right side edges;

wherein each of the counterweight bricks are slidable into the front opening for positioning in the stacked arrangement;

wherein the apparatus further comprises a plurality of shelf members, each of the shelf members extending generally in a lateral direction between the left and right side supports and spaced apart vertically between the top and bottom ends to define a plurality of carrying subsections within the carrying section;

wherein each of the carrying subsections is sized and shaped to receive at least a portion of the counterweight bricks in stacked arrangement and the respective shelf member support the counterweight bricks received by the carrying subsection from below;

wherein each of the shelf members supports the counterweight bricks inclined with the front side edge closer to top end than the rear side edge so that each of the counterweight bricks is inclined at an angle of between five and twenty degrees relative to the lateral direction;

wherein the support structure further comprises first and second body members that extend between the top and bottom ends, each of the body members comprising an elongate side portion, the body members arranged so that the side portions are in generally opposed relation and define the respective left and right side supports, and each of the body members further comprising an elongate back portion connected generally orthogonally to the respective side portion, the body members arranged so that the back portion are generally coplanar and define the back support, and the back portions of the body members are spaced apart to define an elongate gap therebetween; and wherein each of the shelf members comprises a main supporting portion, a rear flange portion that projects generally in the longitudinal direction towards the bottom end, and a front flange portion that projects generally in the longitudinal direction towards the top end, and the front flange portion comprises a brick-supporting lip that extends generally between the side portions of the body members.

10. The system of claim 9, wherein the front and rear flange portions of each of the shelf members comprise respective front and rear tabs extending outwardly relative to the main supporting portion on both sides thereof, and the side portions of the body members include a plurality of first front slots and rear slots for respectively receiving the front and rear tabs of the shelf members.

11. The system of claim 10, wherein upper ends of the rear slots are at the same general position in the longitudinal direction as lower ends of respective ones of the first front slots.

12. The system of claim 11, wherein each of the body members further comprises a plurality of second front slots, and lower ends of the rear slots are at the same general position in the longitudinal direction as upper ends of the respective ones of the second front slots so that the first and second body members are of interchangeable configuration.

13. The apparatus of claim 2, wherein the brick-supporting lip supports at least a portion of the plurality of counterweight bricks inclined with the front side edge closer to the top end than the rear side edge so that each of the counterweight bricks is inclined at an angle of between five and twenty degrees relative to the lateral direction.

14. The system of claim 9, wherein the counterweight bricks are installed into the front opening in an offstage direction generally away from a center of the stage, and removed from the front opening in an onstage direction generally toward the center of the stage.

15. The system of claim 9, wherein, for each of the plurality of shelf members, the brick-supporting lip inclines the counterweight bricks received within the carrying subsections at the angle.

16. A counterweight rigging system for a stage, comprising:

a) a plurality of counterweight bricks, each counterweight brick including top and bottom sides and left, right, front and back side edges defining a generally cuboidal shape allowing stacked arrangement; and b) at least one front-loading arbor apparatus, the apparatus including a support structure extending generally vertically between top and bottom ends, the support structure including a left side support, a back support, and a right side support, the left side, back and right side supports extending generally between the top and bottom ends and defining an elongate carrying section therebetween, the carrying section sized and shaped to receive the plurality of counterweight bricks in stacked arrangement;

wherein a front opening of the carrying section is defined by the left side and right side supports and is at least as wide as a width of each of the counterweight bricks between the left and right side edges;

wherein each of the counterweight bricks are slidable into the front opening for positioning in the stacked arrangement;

wherein the apparatus further comprises a plurality of shelf members, each of the shelf members extending generally in a lateral direction between the left and right side supports and spaced apart vertically between the top and bottom ends to define a plurality of carrying subsections within the carrying section;

wherein each of the carrying subsections is sized and shaped to receive at least a portion of the counterweight bricks in stacked arrangement and the respective shelf member supports the counterweight bricks received by the carrying subsection from below; and wherein each of the shelf members comprises a front flange portion that projects generally in the longitudinal direction towards the top end, each of the front flange portions comprising a brick-supporting lip for supporting the counterweight bricks inclined with the front side edge closer to the top end than the rear side edge so that each of the counterweight bricks is inclined at an angle of between five and twenty degrees relative to the lateral direction.

* * * * *

UNITED STATES PATENT AND TRADEMARK OFFICE

CERTIFICATE OF CORRECTION

PATENT NO. : 8,814,119 B2
APPLICATION NO. : 12/757369
DATED : August 26, 2014
INVENTOR(S) : Richard William Boychuck et al.

It is certified that error appears in the above-identified patent and that said Letters Patent is hereby corrected as shown below:

In the Claims

Column 10

Claim 9, line 1, “support” should be --supports--.

Claim 9, line 18, “portion” should be --portions--.

Signed and Sealed this
Twelfth Day of May, 2015

Michelle K. Lee

Michelle K. Lee
*Director of the United States Patent and Trademark Office*